US006080009A

United States Patent [19]

Yanagihara et al.

[11] Patent Number: 6,080,009

[45] Date of Patent: Jun. 27, 2000

[54] PROTECTIVE STRUCTURE FOR JUNCTIONS

[75] Inventors: Takashi Yanagihara; Nobuyuki Tsujino, both of Shizuoka, Japan

[73] Assignee: Yazaki Corporation, Tokyo, Japan

[21] Appl. No.: 09/246,160

[22] Filed: Feb. 8, 1999

[30] Foreign Application Priority Data

Feb. 10, 1998 [JP] Japan ..... 10-028319

[51] Int. Cl.[7] ..... H01R 13/58

[52] U.S. Cl. ..... 439/456

[58] Field of Search ..... 439/456, 492, 439/164, 67, 493, 468, 459

[56] References Cited

U.S. PATENT DOCUMENTS

| | | | |
|---|---|---|---|
| 3,432,794 | 3/1969 | Churla | 439/456 |
| 3,713,073 | 1/1973 | Narozny | 439/456 |
| 4,195,194 | 3/1980 | Kuster | 439/456 |
| 5,411,313 | 5/1995 | Yamamoto | 439/456 |
| 5,520,550 | 5/1996 | Okabe | 439/456 |
| 5,683,272 | 11/1997 | Abe | 439/456 |
| 5,695,358 | 12/1997 | Myer et al. | 439/456 |
| 5,951,322 | 9/1999 | Nishikigi | 439/456 |

FOREIGN PATENT DOCUMENTS 9-50841 2/1997 Japan .

*Primary Examiner*—Khiem Nguyen
*Assistant Examiner*—J. F. Duverne
*Attorney, Agent, or Firm*—Armstrong, Hattori, McLeland & Naughton

[57] ABSTRACT

A protective structure for junctions consists of a terminal holder including a mount, a plurality of joint terminals arranged on the mount, and a hood which receives one end of the joint terminals; an auxiliary terminal holder including a fixing frame and a plurality of auxiliary terminals arranged on the fixing frame in compliance with the joint terminals; a flat cable held between the terminal holder and the auxiliary terminal holder such that its exposed conductors, the joint terminals and the auxiliary terminals are subjected to welding to provide a junction; a hold-down member fittable to the terminal holder transversely to the flat cable; and a protective cover fittable to the terminal holder to cover a part of the flat cable having been bent back around the hold-down member. Stresses are prevented from directly acting via the flat cable on the junction.

10 Claims, 11 Drawing Sheets

PROTECTIVE STRUCTURE FOR JUNCTIONS

BACKGROUND OF THE INVENTION

1. Field of the Invention

This invention relates to a protective structure for protecting junctions of joint terminals and flat cables.

2. Description of the Related Art

There has conventionally been proposed a junction 90 as shown in FIG. 20 (Japanese Patent Application Unexamined Publication No. Hei 9-50841).

The junction 90 includes a plurality of joint terminals 91 arranged in a row at a desired spacing, auxiliary terminals 92 arranged on an auxiliary terminal holder 93 in compliance with the joint terminals 91, and conductors (not shown) of a flat cable 94 each of which is sandwiched between the respective joint terminal 91 and auxiliary terminal 92 in three layers for joining by, for example, ultrasonic welding. By effecting the ultrasonic welding in this way, ultrasonic welding horns (not shown) are kept from directly contacting the conductors of the flat cable 94 and damaging the conductors.

With the junction 90, however, there has been a fear that during assembly of the junction 90 or use of a junction 90-incorporated product (not shown), stresses directly act on the junction 90 in the directions of X and Y, thereby tending to cause a disconnection of the welded elements.

SUMMARY OF THE INVENTION

In view of the foregoing, an object of this invention is to provide a protective structure for junctions which prevents stresses from directly acting on the junctions.

In order to attain the object, according to this invention, there is provided a protective structure for junctions, which comprises: a terminal holder including a mount, a plurality of joint terminals arranged on the mount at a desired spacing, and a hood adjoining one side of the mount to receive one end of the joint terminals; an auxiliary terminal holder including a fixing frame and a plurality of auxiliary terminals arranged on the fixing frame in compliance with the plurality of joint terminals; a flat cable held between the terminal holder and the auxiliary terminal holder such that exposed conductors of the flat cable, the respective joint terminals and the respective auxiliary terminals are, in a three layer structure, subjected to welding to provide a junction; a hold-down member fittable to the terminal holder in a transverse manner to the flat cable; and a protective cover fittable to the terminal holder to cover a part of the flat cable having been bent back around the hold-down member, whereby to prevent stresses which may act via the flat cable on the junction.

Preferably, the hold-down member is fitted to the terminal holder at a position between the junction and the hood.

Preferably, the hold-down member comprises a cross bar and a pair of opposed arms extending at opposite ends of the cross bar, the arms having locking means at their free ends for locking the hold-down member to the terminal holder.

Preferably, the protective cover is rotatably hinged to one of the opposite ends of the cross bar.

Preferably, the protective cover comprises a press plate for pressing the bent-back part of the flat cable on the auxiliary terminal holder and a pair of opposed side plates extending at opposite ends of the press plate, the side plates having locking means at their free ends for locking the protective cover to the terminal holder.

Preferably, the hold-down member comprises a plate integral with and extending along one side of the auxiliary terminal holder close to the hood.

Preferably, the protective cover is rotatably hinged to one end of the auxiliary terminal holder.

Preferably, the protective cover comprises a press plate for pressing the bent-back part of the flat cable on the auxiliary terminal holder, which press plate is hinged to the one end of the auxiliary terminal holder, and a locking wall provided at a free end of the press plate, the locking wall having a locking means for locking the protective cover to the terminal holder.

Preferably, the terminal holder further includes a pair of locking means provided at opposite lateral ends of the mount for locking the protective cover to the terminal holder, and a pair of locking portions upstanding between the respective locking means and the hood, the pair of locking portions having at their free ends a pair of opposed inner locking projections which serve to preliminarily lock the flat cable to the terminal holder.

Preferably, the protective structure further comprises a dust cover, and the pair of locking portions further have at their free ends a pair of outer locking projections which cooperate with corresponding locking means on the dust cover to lock the dust cover to the terminal holder, whereby to more firmly fix the protective cover to the terminal holder.

The above and other objects, features and advantages of this invention will become apparent from the following description and the appended claims, taken in conjunction with the accompanying drawings.

DESCRIPTION OF THE PREFERRED EMBODIMENTS

Embodiments of this invention will now be described with reference to the attached drawings.

FIGS. 1 to 9 show a first embodiment of a protective structure for junctions according to this invention.

Figure 1:
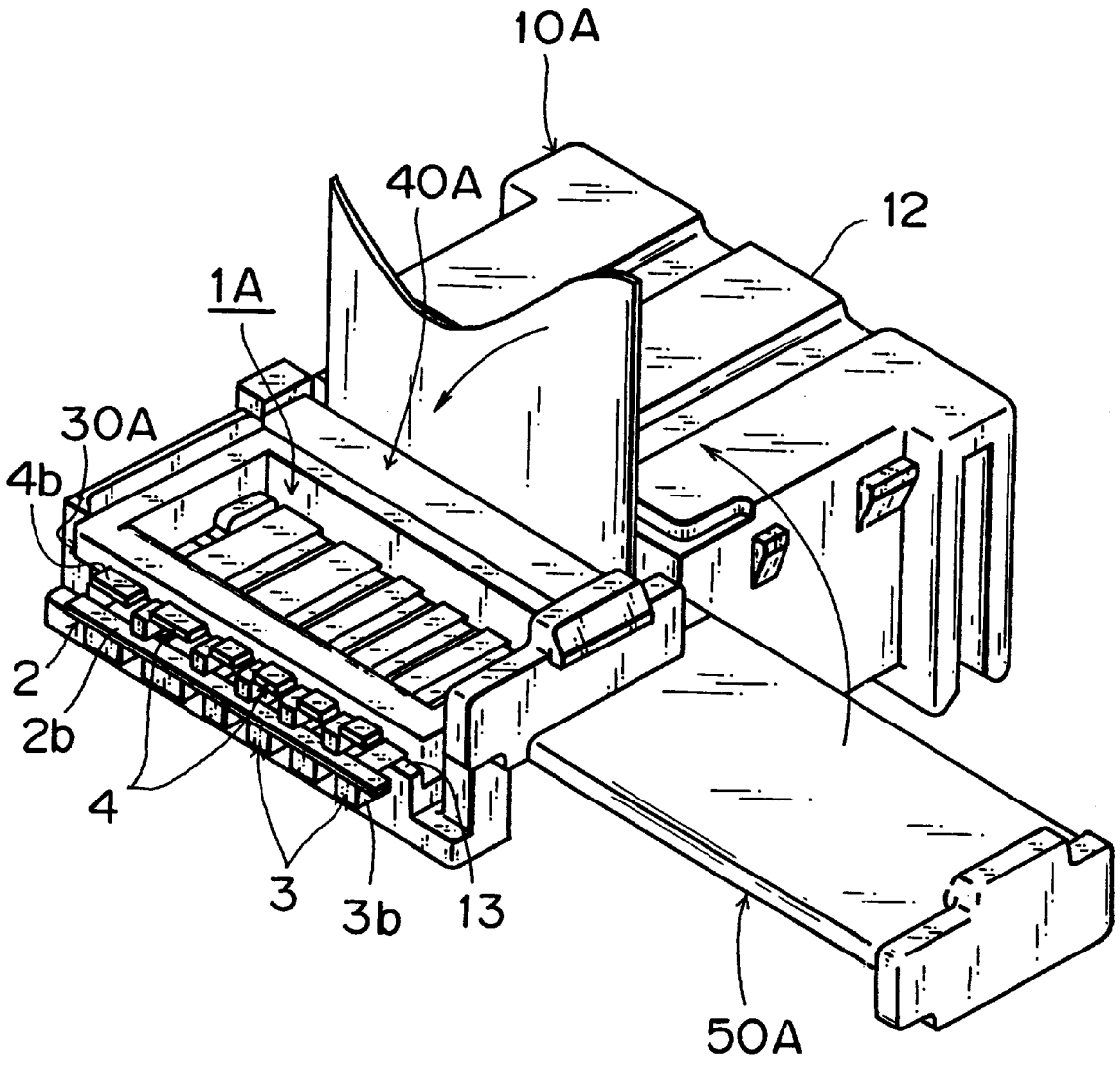
FIG. 1 is a general perspective view of a first embodiment of a protective structure for junctions according to this invention.

In FIG. 1, the junction protective structure includes a junction 1A—which is formed by sandwiching conductors 2*a* of a flat cable 2 between the related joint terminals 3 of a terminal holder 10A and auxiliary terminals 4 of an auxiliary terminal holder 30A and thereafter subjecting them to ultrasonic welding, with ultrasonic welding horns (not shown) directly contacted on the joint terminals 3 and the auxiliary terminals 4—, a hold-down member 40A locked to the terminal holder 10A, and a protective cover 50A fitted to the terminal holder 10A to cover the flat cable 2 which has been bent back around the hold-down member 40A.

Figure 2:
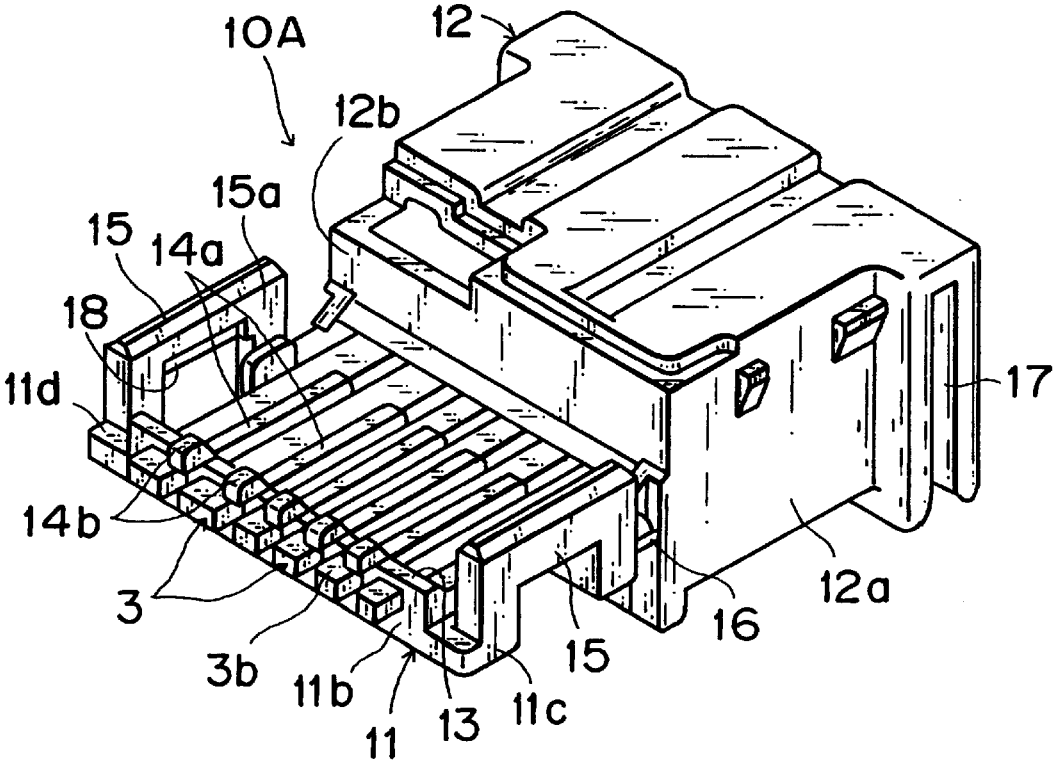
FIG. 2 is a perspective view of a terminal holder of FIG. 1.

As shown in FIGS. 1 and 2, the terminal holder 10A includes a rectangular mount frame 11, the plurality of joint terminals 3 fixed at a desired spacing to the mount frame 11, and a hood 12 continuous to one side 11*a* of the mount frame 11. Each joint terminal 3 extends at one end 3*a* into the hood 12 (FIG. 7) and is supported at the other end 3*b* on both sides 11*a*, 11*b* of the mount frame 11, the side 11*b* cooperating with a rod-like holding wall 13 to fix the joint terminal therebetween. A plurality of positioning ribs 14*a* are located between neighboring joint terminals 3 inside the mount frame 11 to extend parallel to the joint terminals; the holding wall 13 also has a plurality of positioning projections 14*b* at positions on its upper surface between neighboring joint terminals 3; and U-shaped locking members 15 are provided upstanding at opposite lateral ends 11*c*, 11*d* of the mount frame 11.

A locking claw 16 is provided on either side 11*c*, 11*d* of the mount frame 11, between the locking member 15 and the hood 12. On its opposite lateral walls 12*a*, the hood 12 has guide grooves 17 extending perpendicularly to a longitudinal direction of the joint terminals 3. Locking grooves 18 are formed on the respective opposed walls 15*a* of the U-shaped locking members 15.

Figure 3:
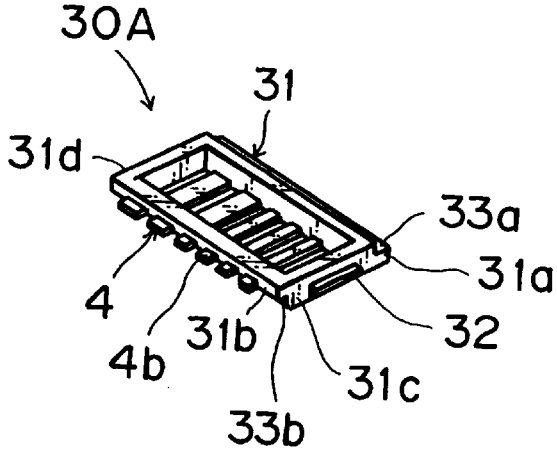
FIG. 3 is a perspective view of an auxiliary terminal holder of FIG. 1.

As shown in FIGS. 1 and 3, the auxiliary terminal holder 30A includes a rectangular fixing frame 31, the plurality of auxiliary terminals 4 arranged on the fixing frame 31 in compliance with the joint terminals 3, and locking projections 32 provided at opposite lateral ends 31*c*, 31*d* of the fixing frame 31. The fixing frame 31 has a forward step portion 33*a* and a rearward step portion 33*b*, which are symmetrical to each other by 180° rotation. (Forward indicates a direction toward the hood 12 and rearward the opposite direction.) The auxiliary terminal 4 is at one end 4*a* (FIG. 7) fixed to one side 31*a* of the fixing frame 31 and has, near the other end 4*b*, a bent portion which is fixed inside the other side 31*b* of the fixing frame 31 to have the other end 4*b* fixed to the fixing frame rearward step portion 33*b*.

The locking projections 32 are engaged in the locking grooves 18 of the terminal holder 10A. On the underside of the fixing frame 31 are formed a plurality of positioning grooves 34*b* corresponding to the plurality of positioning projections 14*b* on the terminal holder 10A. On engagement of the locking projections 32 of the auxiliary terminal holder 30A with the locking grooves 18 of the terminal holder 10A, the positioning ribs 14*a* on the terminal holder 10A project through between neighboring flat cable conductors 2*a* and between auxiliary terminals 4.

Figure 4:
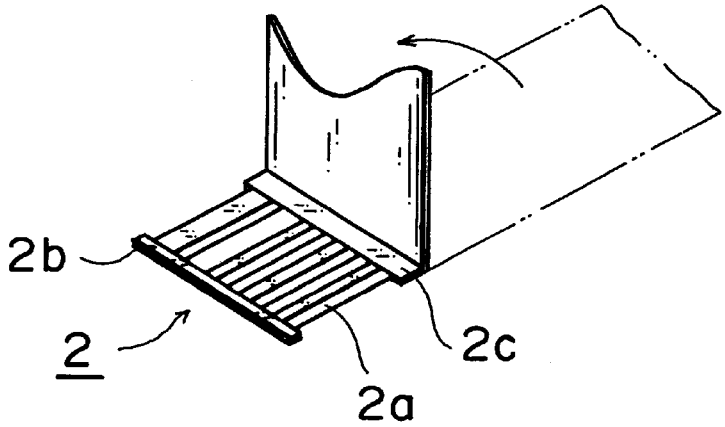
FIG. 4 is a perspective view of a flat cable of FIG. 1.

As shown in FIG. 4, the flat cable 2 includes the plurality of conductors 2*a* arranged parallel and at the same spacing, which are as a whole covered with insulating resin. In compliance with the plurality of conductors 2*a* exposed out of the flat cable 2 are arranged in a row the joint terminals 3 and auxiliary terminals 4.

Figure 5A:
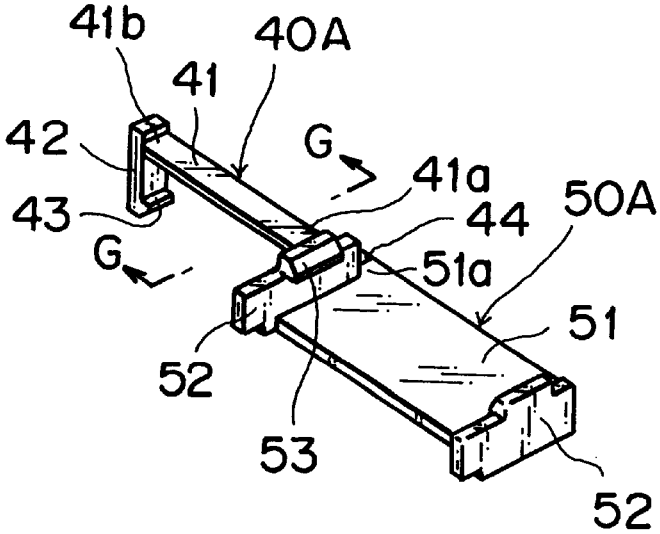
FIG. 5A is a perspective view of a hold-down member and a protective cover of FIG. 1.
Figure 5B:
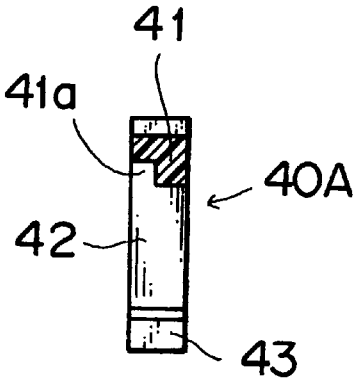
FIG. 5B is a sectional view taken along the line G—G of FIG. 5A.

As shown in FIGS. 1, 5A and 5B, the hold-down member 40A includes a cross bar 41 and a pair of arms 42, 42 extending in the same direction at opposite ends 41*a*, 41*b* of the cross bar 41. The pair of arms 42, 42 are provided at their free ends with opposed locking projections 43. The cross bar 41 and the pair of arms 42, 42 as a whole form a clamp-shaped locking frame. On one end 41*a* of the cross bar 41 is rotatably supported the protective cover 50A via a hinge 44. On the underside of the cross bar 41 is formed an engagement step portion 41*a* (FIG. 5B). The locking projections 43 are engaged with the locking claws 16 of the terminal holder 10A, with the engagement step portion 41*a* engaged on the forward step portion 33*a* (FIG. 3) of the auxiliary terminal holder 30A.

The protective cover 50A includes a press plate 51 which presses on the flat cable 2 having been bent around the cross bar 41. The press plate 51 has at opposite ends thereof a pair of side wall plates 52, 52 extending in the same direction, which are provided at their free ends with a pair of opposed locking projections 53, 53. The hinge 44 extends from one of the opposite ends 51*a* of the press plate 51. The locking projections 53 engage with the locking members 15 of the terminal holder 10A.

The process for assembling the protective cover 50A to the terminal holder 10A to protect the junction 1A will now be described.

Figure 6:
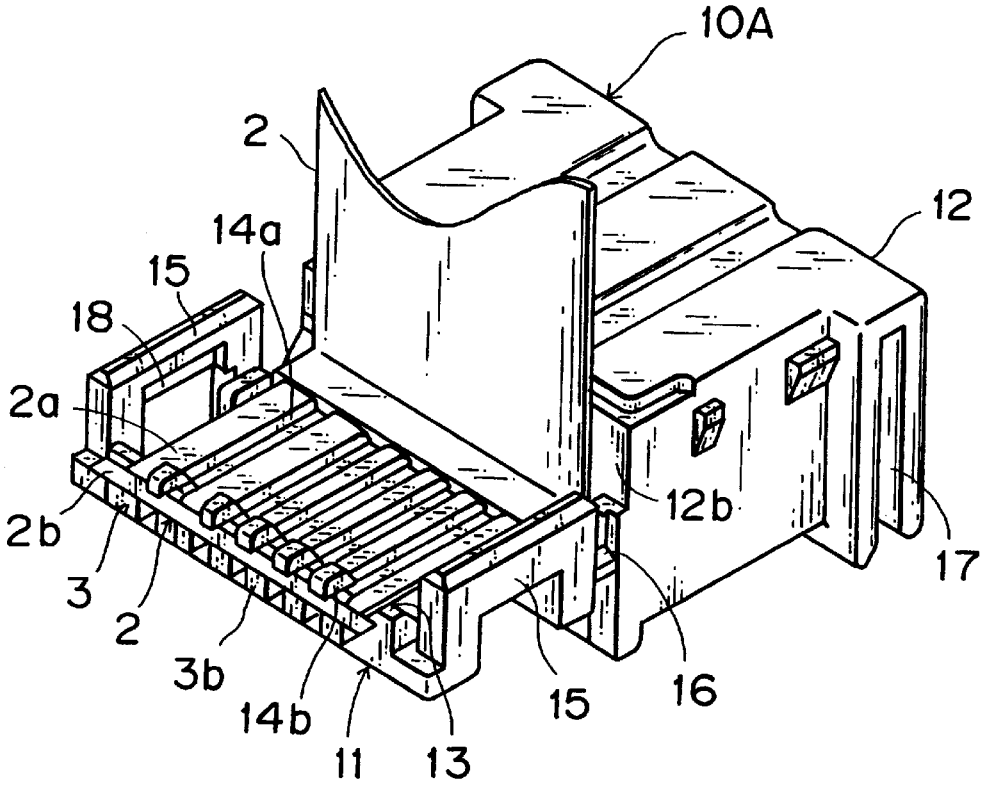
FIG. 6 is a perspective view of the terminal holder of FIG. 1, with the flat cable arranged thereon.

As shown in FIG. 4, the insulating resin is removed to expose the conductors 2*a* near a tip end of the flat cable 2, leaving an insulating cover 2*b* at the tip end. As shown in FIG. 6, the flat cable conductors 2*a* are arranged on the mount frame 11 of the terminal holder 10A having the plurality of joint terminals 3 arranged and fixed thereon in advance (FIG. 2). In this instance, the tip end insulating cover 2*b* is first hooked to the holding wall 13 and the positioning projections 14*b* on the terminal holder 10A, followed by placing the flat cable conductors 2*a* on the respective joint terminals 3. The flat cable 2 abuts against a rear wall 12*b* of the hood 12 to be bent upwardly there.

On pushing in, from above, the auxiliary terminal holder 30A of FIG. 3 onto the flat cable conductors 2*a*, the locking projections 32 (FIG. 3) of the auxiliary terminal holder 30A engage in the locking grooves 18 (FIG. 2) of the terminal holder 10A, at which time, as indicated in FIG. 1, the auxiliary terminals 4 are arranged on the respective flat cable conductors 2*a*. In other words, the flat cable conductors 2*a* are fixedly held, in a sandwiched manner, between the respective joint terminals 3 and auxiliary terminals 4. These three layers are then subjected to welding by ultrasonic welding to provide the junction 1A. The tip end insulating cover 2*b* is located between the ends 3*b* of the joint terminals 3 and the ends 4*b* of the auxiliary terminals 4.

Figure 7:
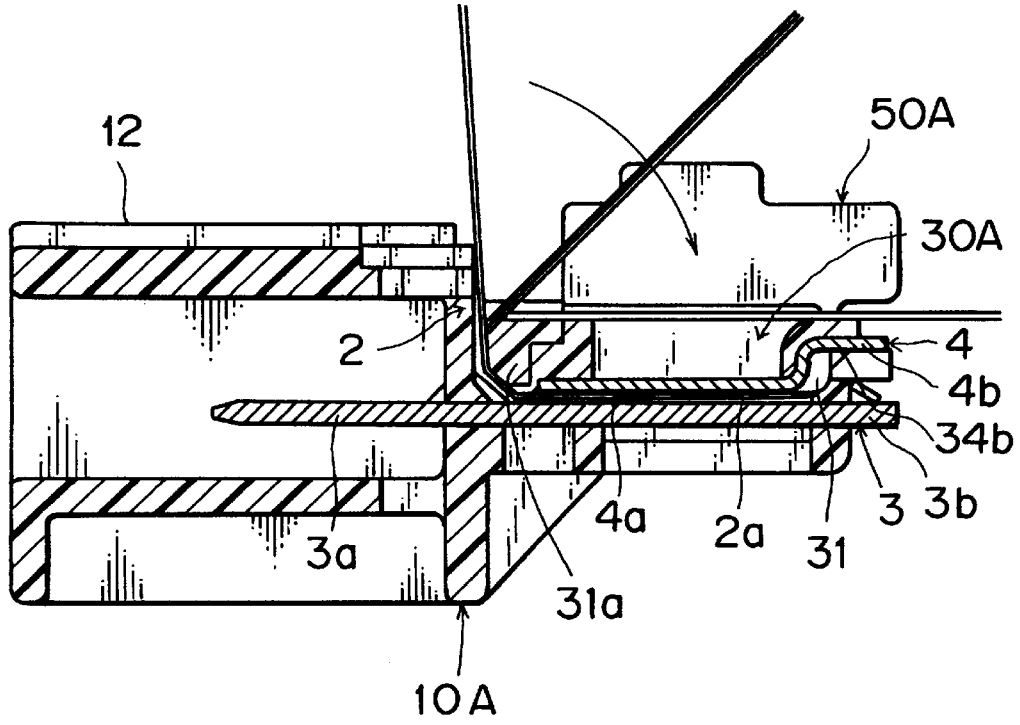
FIG. 7 is a sectional view of a condition where the flat cable of FIG. 6 is bent back.
Figure 8:
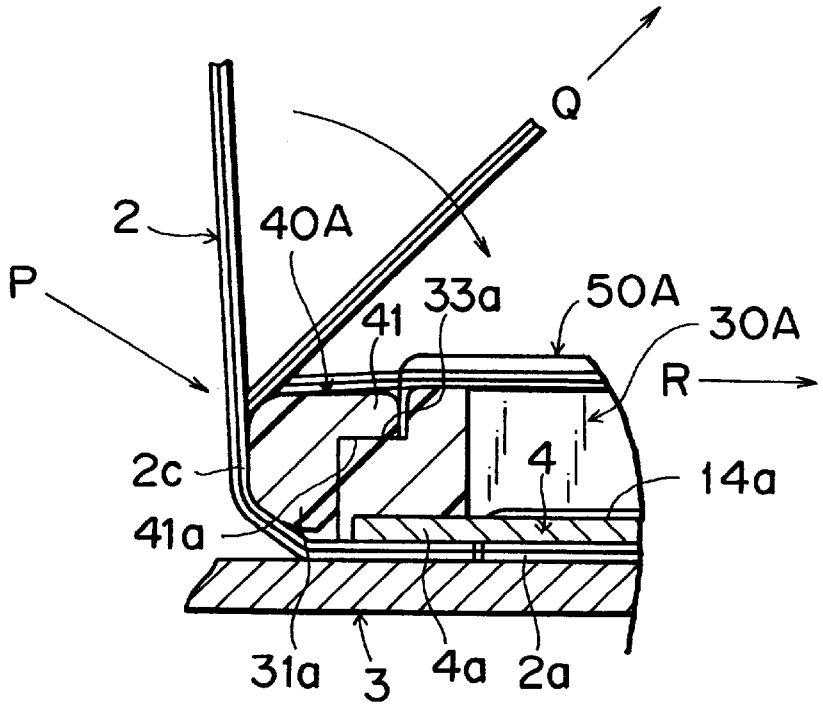
FIG. 8 is a partial enlarged view of FIG. 7.

The pair of arms 42, 42 of the hold-down member 40A of FIGS. 5A and 5B are then inserted, from above, between the locking members 15 and the hood 12 until their locking projections 43 engage with the terminal holder locking claws 16 as shown in FIG. 2, at which time, as shown in FIGS. 1, 7 and 8, the engagement step portion 41*a* of the cross bar 41 engages on the forward step portion 33*a* of the auxiliary terminal holder 30A, so that the cross bar 41 presses a rear portion 2*c* of the flat cable 2 toward the terminal holder 10A. The flat cable 2 is located between the rod 41 and the hood 12.

Figure 9:
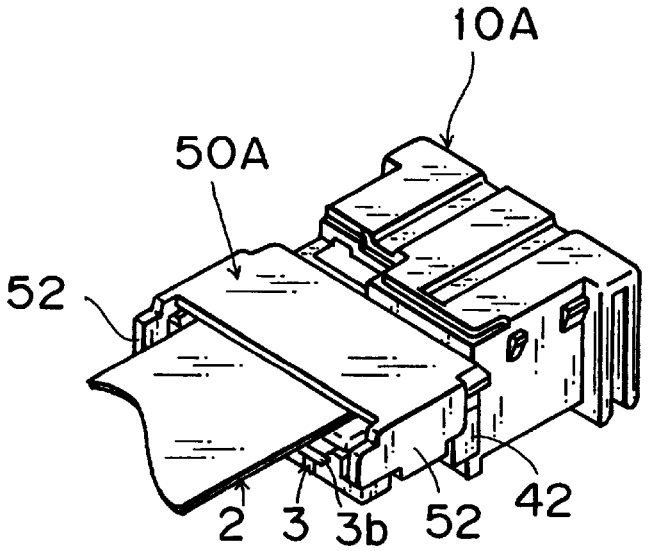
FIG. 9 is a perspective view similar to FIG. 1, showing the flat cable bent back and the protective cover fitted to the terminal holder.

The flat cable 2 is bent around the cross bar 41 (FIG. 8), and the protective cover 50A is fitted to the terminal holder 10A to cover the thus bent flat cable 2 (FIG. 9). At this time, the locking projections 53 (FIG. 5A) of the protective cover 50A are engaged with the locking members 15 (FIG. 2) of the terminal holder 10A. The junction 1A is thus protected by the protective cover 50A.

In other words, as shown in FIGS. 7 and 8, due to the structure in which the flat cable 2 is bent around the cross bar 41, whose position is shifted from the junction 1A, and pressed down by the protective cover 50A, a stress in the direction of Q which is caused at the time of bending the flat cable 2 and a stress in the direction of R which is caused in use of the junction-incorporated product (not shown) are counteracted by the coincident action in the direction of P which tends to press the flat cable 2 on the cross bar 41. The junction 1A is thus made free of the stresses from outside, leading to an improved reliability of the junction 1A.

FIGS. 10 to 19 show a second embodiment of a protective structure for junctions according to this invention. In these figures, like constituent parts or elements as in the first embodiment are denoted by like reference characters and their detailed description will be omitted.

Figure 10:
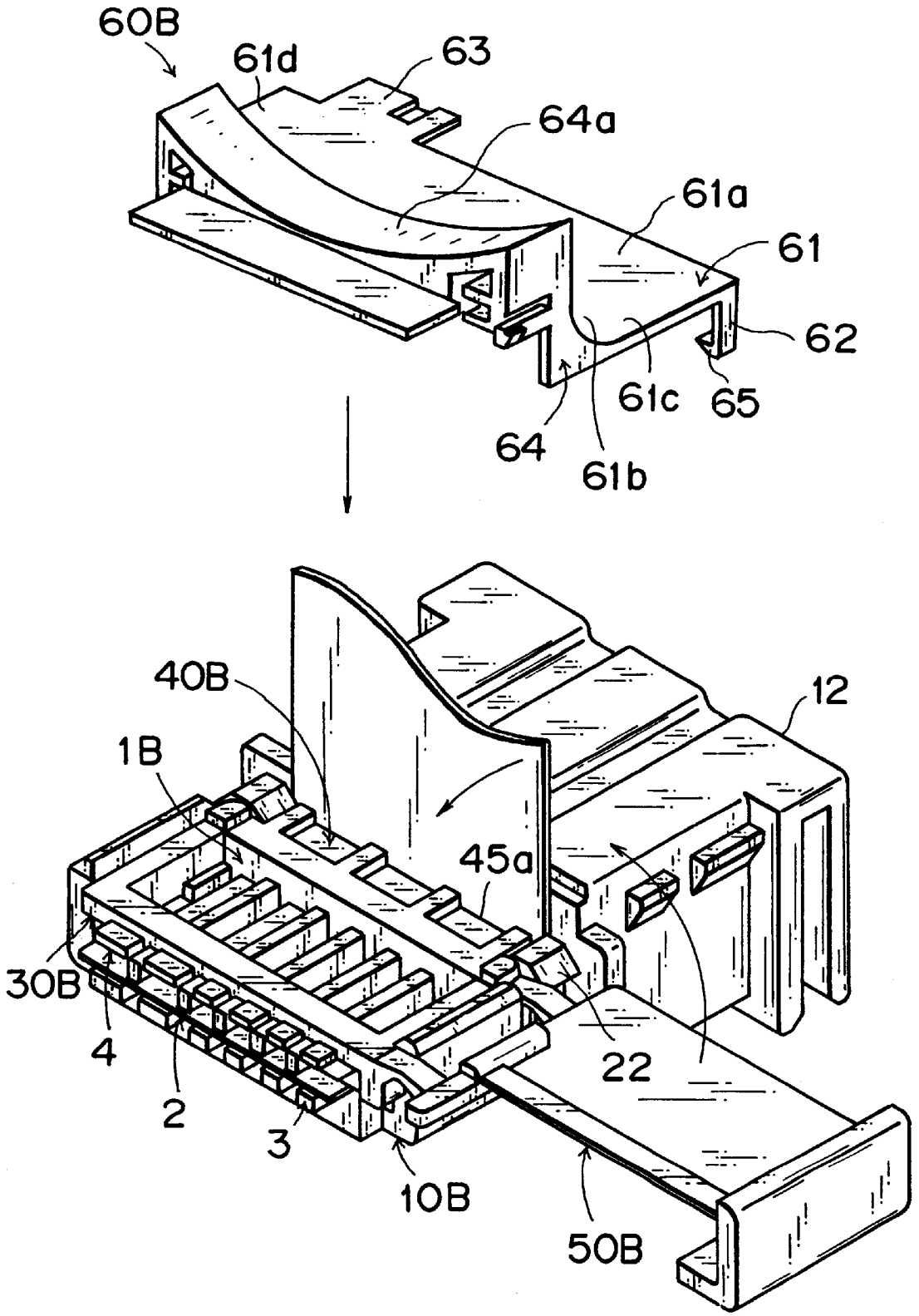
FIG. 10 is a general perspective view of a second embodiment of a protective structure for junctions according to this invention.
Figure 11:
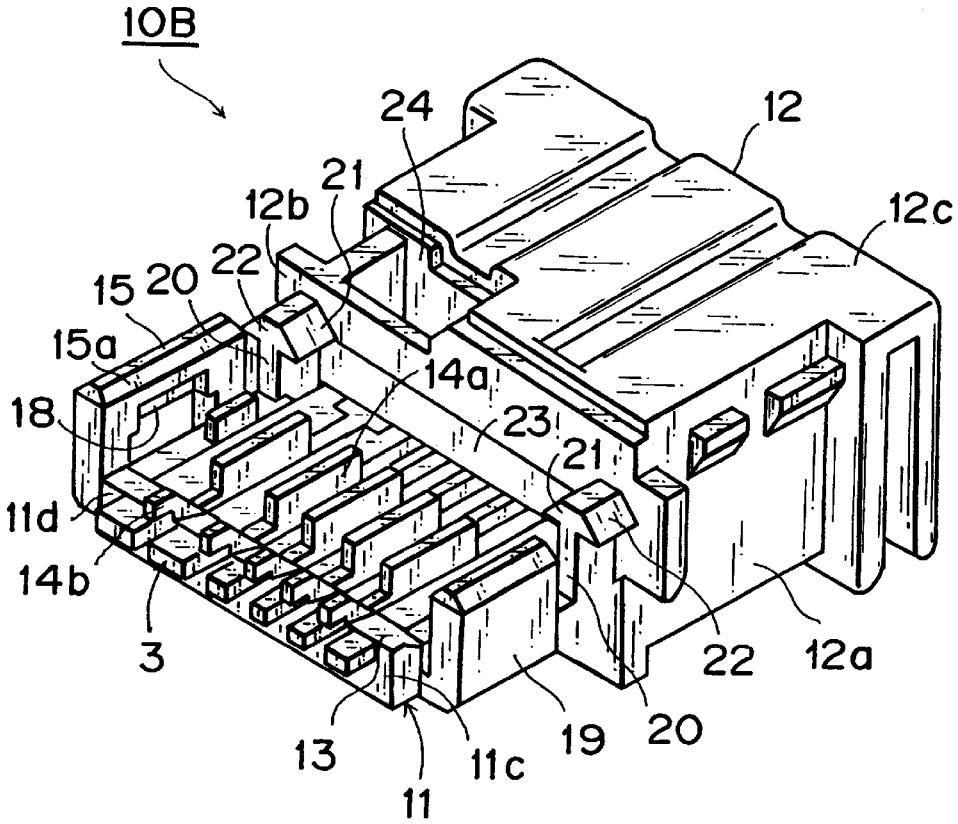
FIG. 11 is a perspective view of a terminal holder of FIG. 10.

In FIG. 10, the junction protective structure includes a junction 1B—which is formed by sandwiching conductors 2*a* of a flat cable 2 between the related joint terminals 3 of a terminal holder 10B and auxiliary terminals 4 of an auxiliary terminal holder 30B and thereafter subjecting them to ultrasonic welding—, a hold-down member 40B locked to the terminal holder 10B, a protective cover 50B fitted to the terminal holder 10B to cover the flat cable 2 which has been bent back around the hold-down member 40B, and a dust cover 60B fitted to the terminal holder 10B so as to cover the protective cover 50B. As shown in FIG. 11, the terminal holder 10B includes a mount frame 11, the plurality of joint terminals 3 fixedly arranged on the mount frame 11, and a hood 12 continuous to one side 11*a* of the mount frame 11. The mount frame 11 has a locking wall 19 upstanding at one lateral end 11*c* and a U-shaped locking member 15 upstanding at the other lateral end 11*d*, the locking wall and the locking member being formed with a pair of opposed locking grooves 18, 18.

A locking portion 20 is provided between the locking wall 19 and the hood 12 and between the locking member 15 and the hood 12. The pair of locking portions 20, 20 are provided at their free ends with a pair of opposed inner locking projections 21, 21 and outer locking projections 22, 22. A surface 23 is formed between the mount frame 11 and the hood 12 which inclines to the mount frame. The hood 12 has a window 24 formed in its upper wall 12*c*, adjacent the rear wall 12*b*.

Figure 12:
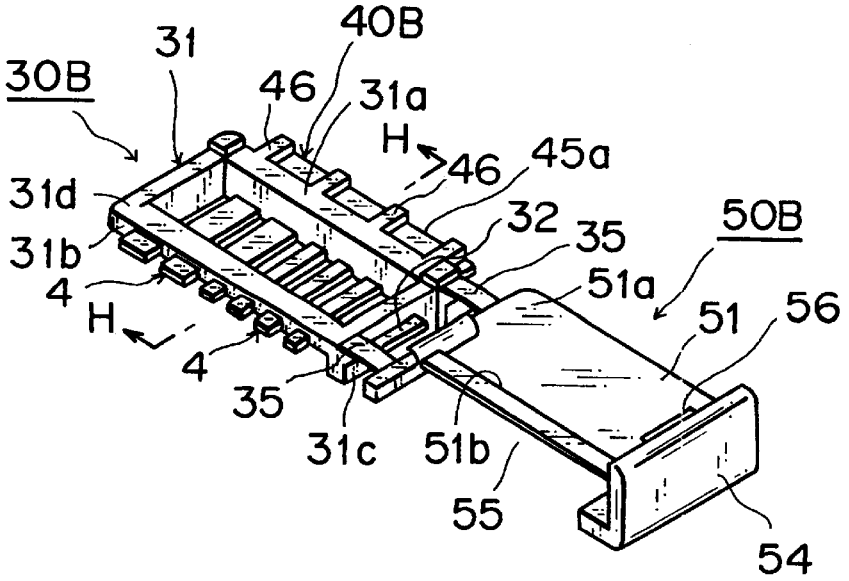
FIG. 12 is a perspective view of an auxiliary terminal holder of FIG. 10.
Figure 13:
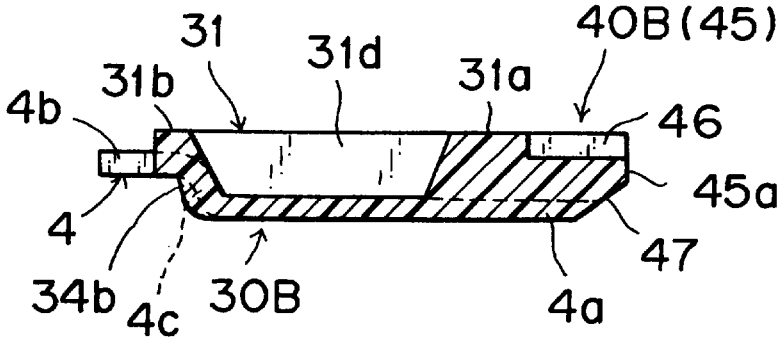
FIG. 13 is a sectional view taken along the line H—H of FIG. 12.

As shown in FIGS. 12 and 13, the auxiliary terminal holder 30B includes a rectangular fixing frame 31, the plurality of auxiliary terminals 4 arranged on the fixing frame 31 in compliance with the joint terminals 3, and locking projections 32 provided at opposite lateral ends 31*c*, 31*d* of the fixing frame 31. The protective cover 50B is rotatably supported via a pair of hinges 35, 35 at one end 31*c* of the fixing frame 31, between which pair of hinges is located one of the locking projections 32. The fixing frame 31 is provided at a front side 31*a* with a hold-down member 40B in the form of a forwardly extended plate.

The auxiliary terminal 4 is at one end 4*a* fixed to the underside of the hold-down member 40B and has, near the other end 4*b*, a bent portion 4*c* which is embedded in a rear side 31*b* of the fixing frame 31, with the other end 4*b* of the auxiliary terminal 4 protruding out of the fixing frame 31. On the underside, at the rear side 31*b*, of the fixing frame 31 are formed positioning grooves 34*b*, each located between neighboring auxiliary terminals 4 in arranged condition. The hold-down member 40B has a plurality of fixing ribs 46 extending on an upper surface thereof in parallel to the auxiliary terminals 4 and a taper surface 47 formed on a lower surface thereof.

The protective cover 50B has a rectangular press plate 51 which presses the bent-back flat cable 2 on the terminal holder 10B, the press plate being connected at one end 51*a* via the pair of hinges 35, 35 to the fixing frame 31 and provided at the other end 51*b* with a side wall plate 54. A rear end portion 51*b* of the press plate 51 is cut away to provide an exit 55 for the flat cable 2. The side wall plate 54 is provided with a locking portion 56 engageable with the locking member 15 of the terminal holder 10B.

The dust cover 60B, as shown in FIG. 10, includes a rectangular body 61, a pair of legs 62, 62 extending downwardly at opposite lateral ends 61*c*, 61*d* of the body, a lid 63 for the window 24 of the hood 12, which is provided at the front side 61*a* of the body, and an upright wall 64 provided at the rear side 61*b* of the body. The pair of legs 62, 62 are provided at their free ends with a pair of opposed locking portions 65, 65. The upright wall 64 has an upper surface 64*a* curved in a concave manner. The locking portions 65 engage with the outer locking projections 22 of the terminal holder 10B to lock the duct cover 60B to the terminal holder 10B.

The process for assembling the protective cover 50B to the terminal holder 10B to protect the junction 1B will now be described.

Figure 14:
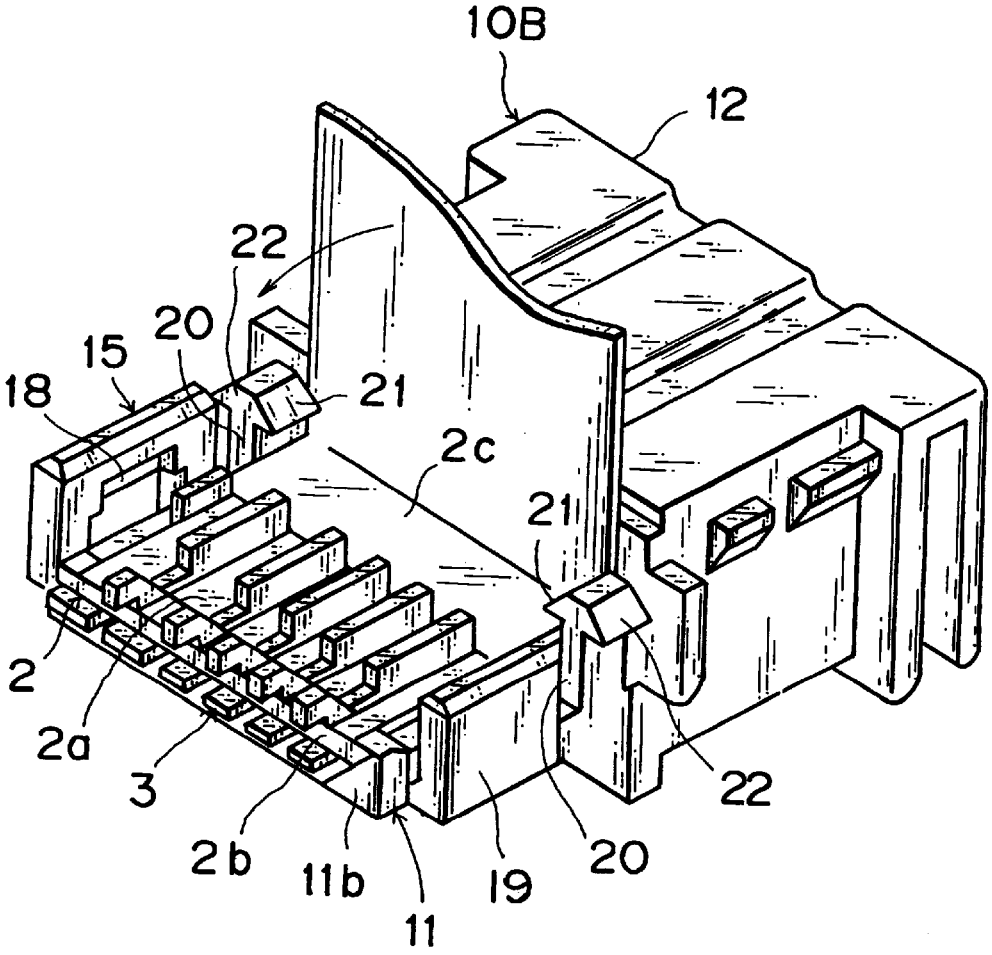
FIG. 14 is a perspective view of the terminal holder of FIG. 10, with the flat cable arranged thereon.

As shown in FIG. 14, the flat cable 2 is arranged on the mount frame 11 so that the tip end insulating cover 2*b* of the flat cable 2 is caught by the positioning projections 14*b* provided at the mount frame rear end 11*b* and the cable conductors 2*a* are laid on the respective joint terminals 3. The inner locking projections 21 of the terminal holder 10B serve to place the flat cable 2 in a preliminary locked position as shown. The flat cable 2 is thus prevented from coming out of place.

The auxiliary terminal holder 30B is then fitted to the terminal holder 10B by engaging its locking projections 32 (FIG. 12) with the locking grooves 18 (FIG. 11) of the terminal holder 10B, with the flat cable 2 being bent upwardly at the rear end of the hood 12. Since the flat cable 2 and thus its conductors 2*a* are preliminarily locked in place as mentioned above, the auxiliary terminals 4 can be easily laid on the respective conductors 2*a* by fitting the auxiliary terminal holder 30B to the terminal holder 10B. In this instance, the taper surface 47 (FIG. 13) formed on the hold-down member 40B of the auxiliary terminal holder 30B and the inclined surface 23 (FIG. 11) of the terminal holder 10B cooperate with each other to hold the flat cable 2 therebetween.

The joint terminals 3, the flat cable conductors 2*a* and the auxiliary terminals 4, after laid one upon another in the three layer structure as shown in FIG. 10, are subjected to welding together by, for example, ultrasonic welding to provide the junction 1B.

Figure 15:
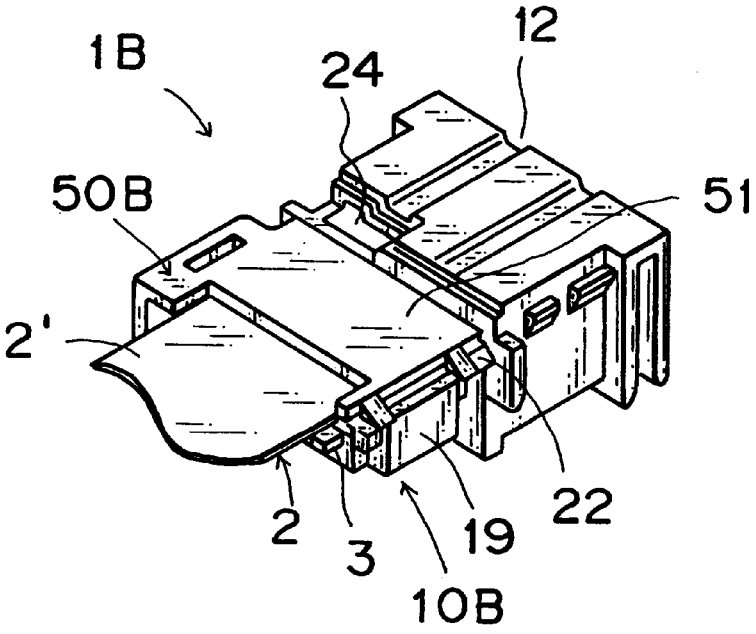
FIG. 15 is a perspective view similar to FIG. 10, showing the flat cable bent back and a protective cover fitted to the terminal holder.

After the flat cable 2 is bent back around the hold-down member 40B, the auxiliary terminal holder supported protective cover 50B is rotated to be fitted to the terminal holder 10B and cover the bent-back flat cable 2. The protective cover 50B is locked to the terminal holder 10B by the engagement of its locking portion 56 (FIG. 12) with the locking member 15 (FIG. 11) of the terminal holder 10B, at which time the press plate 51 of the protective cover 50B presses the bent-back flat cable 2 on the terminal holder 10B as shown in FIG. 15.

Figure 16:
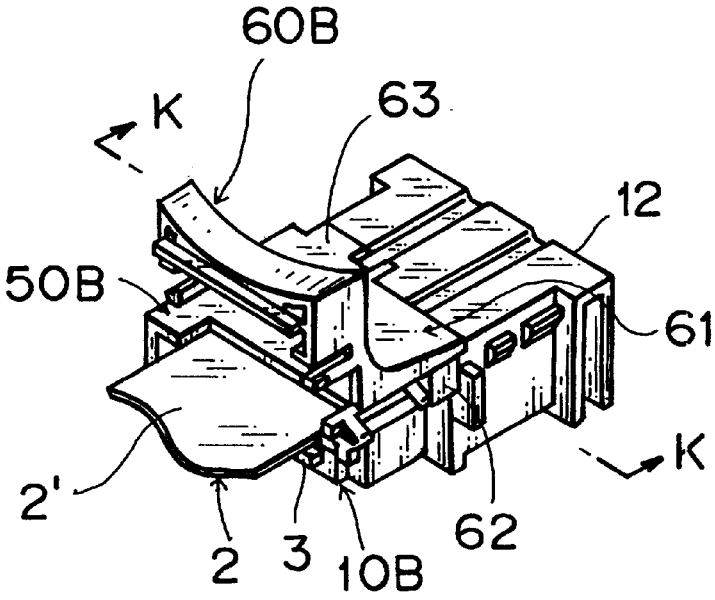
FIG. 16 is a view similar to FIG. 15, with a dust cover assembled.
Figure 17:
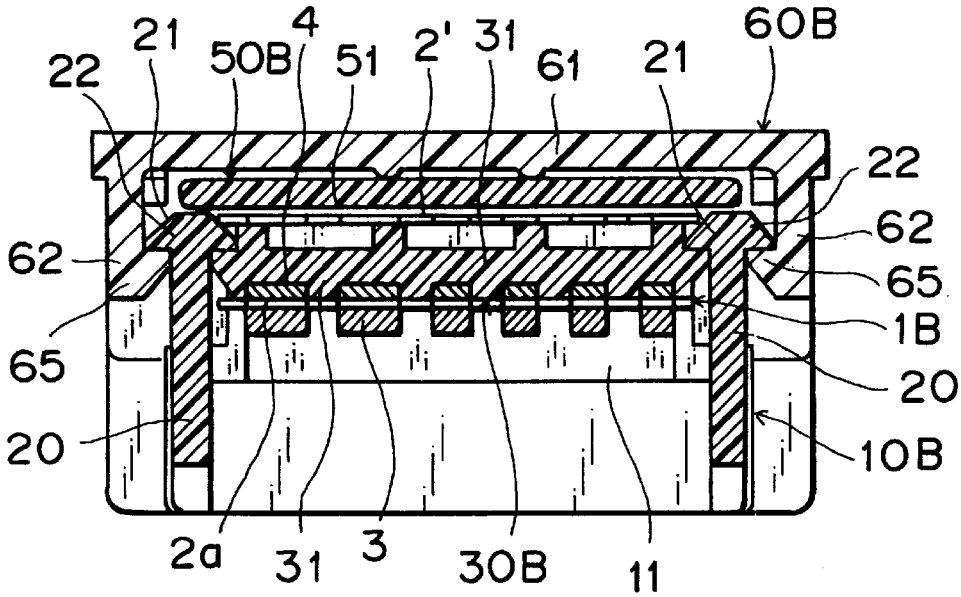
FIG. 17 is a sectional view taken along the line K—K of FIG. 16.

As shown in FIG. 10, the duct cover 60B is then assembled in such a manner as to cover the protective cover 50B, by engaging its locking portions 65 with the outer locking projections 22 of the terminal holder 10B, at which time as shown in FIGS. 16 and 17 the lid 63 of the dust cover 60B closes the window 24 provided in the hood 12, thereby more firmly fixing the protective cover 50B to the terminal holder 10B.

Figure 18:
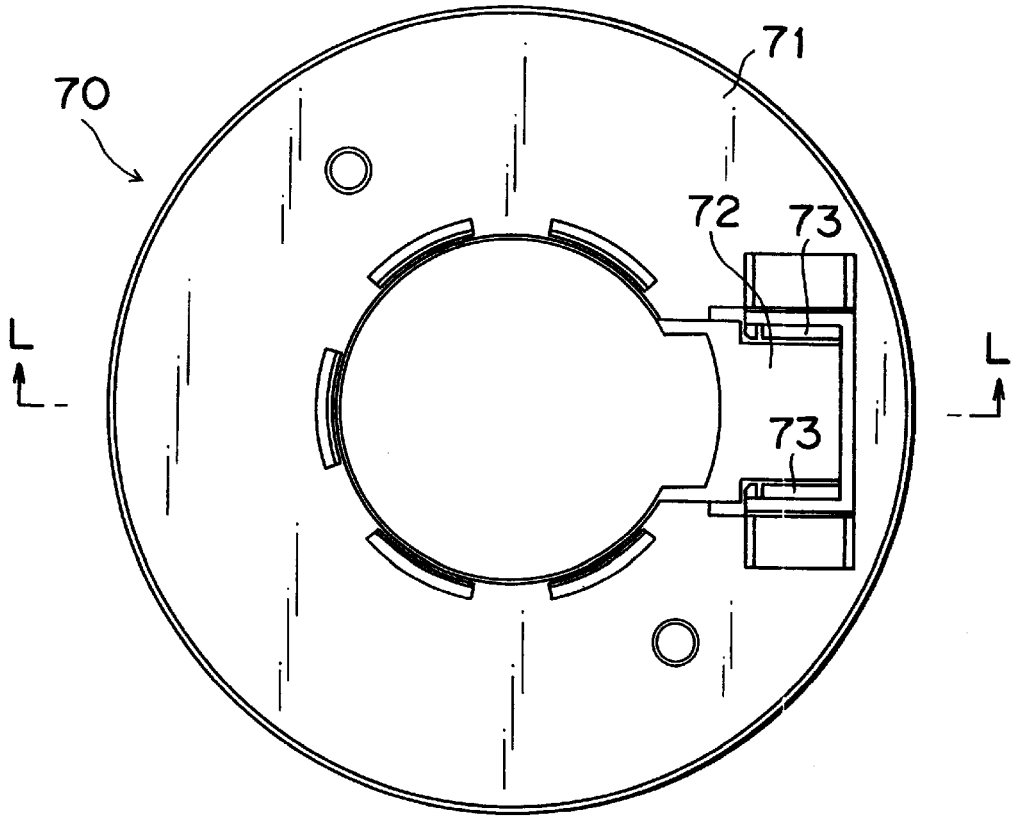
FIG. 18 is a plan view of an upper cover which receives the assembled protective structure of FIG. 16.
Figure 19:
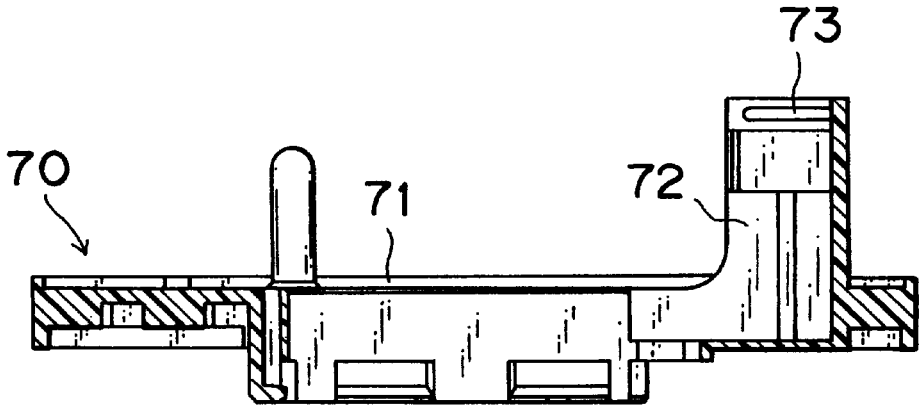
FIG. 19 is a sectional view taken along the line L—L of FIG. 18.
Figure 20:
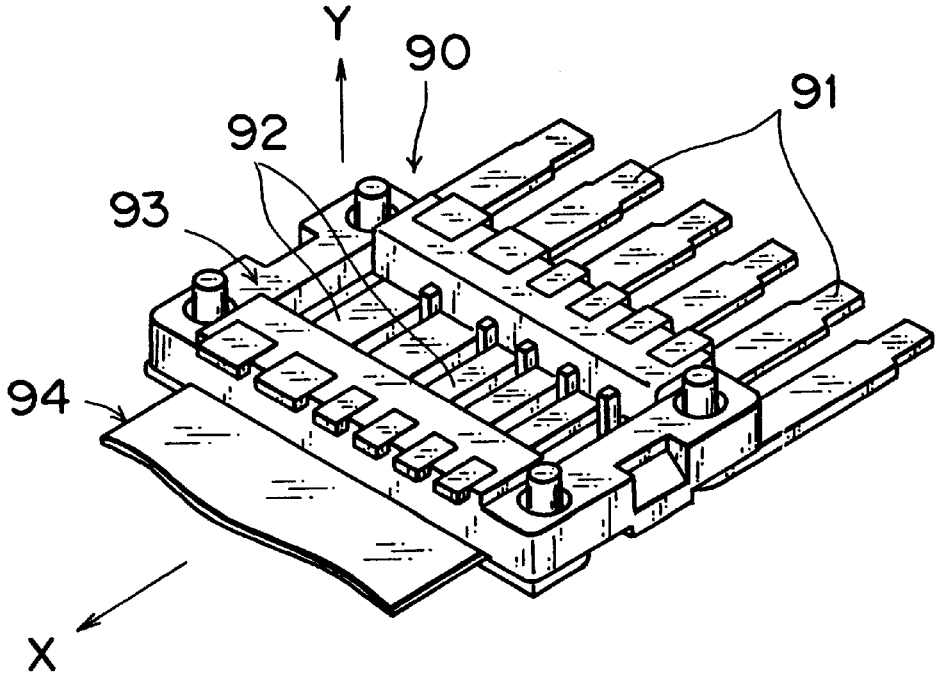
FIG. 20 PRIOR ART
FIG. 20 is a perspective view of a conventional junction.

The thus obtained protective structure is inserted in a receiver portion 72 of U-shaped cross section provided upright on a disc-like body 71 of an upper cover 70 as shown in FIGS. 18 and 19. In other words, the structure is received in the receiver portion 72 of the upper cover 70, its guide grooves being guided by guide rails 73 of the receiver portion 72.

Having now fully described the invention, it will be apparent to one of ordinary skill in the art that many changes and modifications can be made thereto without departing from the spirit and scope of the invention as set forth herein.

What is claimed is:

1. A protective structure for junctions comprising:

a terminal holder including a mount, a plurality of joint terminals arranged on said mount at a desired spacing, and a hood adjoining one side of said mount to receive one end of said joint terminals;

an auxiliary terminal holder including a fixing frame and a plurality of auxiliary terminals arranged on said fixing frame in compliance with said plurality of joint terminals;

a flat cable held between said terminal holder and said auxiliary terminal holder such that exposed conductors of said flat cable, said respective joint terminals and said respective auxiliary terminals are, in a three layer structure, subjected to welding to provide a junction;

a hold-down member fittable to said terminal holder in a transverse manner to said flat cable; and a protective cover fittable to said terminal holder to cover a part of said flat cable having been bent back around said hold-down member, whereby to prevent stresses which may act via said flat cable on said junction.

2. The protective structure according to claim 1, wherein said hold-down member is fitted to said terminal holder at a position between said junction and said hood.

3. The protective structure according to claim 1, wherein said hold-down member comprises a cross bar and a pair of opposed arms extending at opposite ends of said cross bar, said arms having locking means at their free ends for locking said hold-down member to said terminal holder.

4. The protective structure according to claim 3, wherein said protective cover is rotatably hinged to one of said opposite ends of said cross bar.

5. The protective structure according to claim 1, wherein said protective cover comprises a press plate for pressing said bent-back part of said flat cable on said auxiliary terminal holder and a pair of opposed side plates extending at opposite ends of said press plate, said side plates having locking means at their free ends for locking said protective cover to said terminal holder.

6. The protective structure according to claim 1, wherein said hold-down member comprises a plate integral with and extending along one side of said auxiliary terminal holder close to said hood.

7. The protective structure according to claim 6, wherein said protective cover is rotatably hinged to one end of said auxiliary terminal holder.

8. The protective structure according to claim 7, wherein said protective cover comprises a press plate for pressing said bent-back part of said flat cable on said auxiliary terminal holder, which press plate is hinged to said one end of said auxiliary terminal holder, and a locking wall provided at a free end of said press plate, said locking wall having a locking means for locking said protective cover to said terminal holder.

9. The protective structure according to claim 1, wherein said terminal holder further includes a pair of locking means provided at opposite lateral ends of said mount for locking said protective cover to said terminal holder, and a pair of locking portions upstanding between said respective locking means and said hood, said pair of locking portions having at their free ends a pair of opposed inner locking projections which serve to preliminarily lock said flat cable to said terminal holder.

10. The protective structure according to claim 9, further comprising a dust cover, and wherein said pair of locking portions further have at their free ends a pair of outer locking projections which cooperate with corresponding locking means on said dust cover to lock said dust cover to said terminal holder, whereby to more firmly fix said protective cover to said terminal holder.

* * * * *